United States Patent [19]

Hoppie et al.

[11] Patent Number: 4,726,336

[45] Date of Patent: Feb. 23, 1988

[54] UV IRRADIATION APPARATUS AND METHOD FOR FUEL PRETREATMENT ENABLING HYPERGOLIC COMBUSTION

[75] Inventors: Lyle O. Hoppie, Birmingham; Richard Chute, Troy; David H. Scharnweber; Kenneth P. Waichunas, both of Milford, all of Mich.

[73] Assignee: Eaton Corporation, Cleveland, Ohio

[21] Appl. No.: 813,892

[22] Filed: Dec. 26, 1985

[51] Int. Cl.[4] ..... F02P 23/04; F02M 27/08

[52] U.S. Cl. ..... 123/292; 123/276; 123/143 B; 123/537; 123/558

[58] Field of Search ..... 123/143 B, 275, 276, 123/280, 292, 536, 537, 538, 557, 558, 143 R; 431/6

[56] References Cited

U.S. PATENT DOCUMENTS

| | | | |
|---|---|---|---|
| 1,727,919 | 9/1929 | Weckerle | 123/536 |
| 3,361,353 | 1/1968 | Millman | 123/538 X |
| 3,473,879 | 10/1969 | Berberich | 123/143 B X |
| 3,841,824 | 10/1974 | Bethel | 431/8 |
| 4,034,557 | 7/1977 | Cerkanowicz | 431/6 |
| 4,043,308 | 8/1977 | Cerkanowicz | 123/143 R |
| 4,091,779 | 5/1978 | Säufferer et al. | 123/536 |
| 4,124,003 | 11/1978 | Abe et al. | 123/536 |
| 4,314,530 | 2/1982 | Giacchetti | 123/143 B X |
| 4,386,595 | 6/1983 | Young | 123/536 X |
| 4,416,226 | 11/1983 | Nishida et al. | 123/143 B |
| 4,434,753 | 3/1984 | Mukainakano et al. | 123/143 B |
| 4,522,173 | 6/1985 | Agache | 123/276 |
| 4,556,020 | 12/1985 | Hickling | 123/536 |

FOREIGN PATENT DOCUMENTS

| | | | |
|---|---|---|---|
| 0673253 | 10/1963 | Canada | 123/536 |

*Primary Examiner*—Willis R. Wolfe, Jr.

*Attorney, Agent, or Firm*—J. Gordon Lewis; John R. Benefiel

[57] ABSTRACT

An arrangement and method is disclosed for enabling hypergolic combustion of a fuel mixture in the combustion chamber of a combustion device such as an internal combustion engine by irradiation of the fuel and/or of the fuel-air mixture with a beam of ultraviolet radiation to produce disassociation of a relatively high proportion of the fuel molecules to enable hypergolic combustion. Various arrangements are disclosed for accomplishing UV irradiation of the fuel in the context of an internal combustion piston engine, and a mercury vapor lamp or a laser are alternatively employed as a UV beam generator.

3 Claims, 5 Drawing Figures

UV IRRADIATION APPARATUS AND METHOD FOR FUEL PRETREATMENT ENABLING HYPERGOLIC COMBUSTION

BACKGROUND OF THE INVENTION

1. Field of the Invention.

The present invention involves combustion devices, of the type including a combustion chamber within which is burned a fuel and oxidant mixture.

2. Description of the Prior Art.

In U.S. Pat. No. 4,448,176 there is dislcosed a method for reducing the ignition delay of fuel by heating the fuel to a temperature on the order of 1000° F. prior to combustion. As developed in this aforementioned U.S. patent, the heating causes dissassociation of a greatly increased proportion of the fuel molecules and the resultant formation of radicals than exist at lower temperatures, by excitment of the fuel molecules to higher energy states.

As also described in detail in SAE Paper 850089 "Hypergolic Combustion in an Internal Combustion Engine", and SAE Paper 820536 "The Influence of Initial Fuel Temperature on Ignition Delay", incorporated herein by reference, the presence of a relatively high proportion (i.e., $3\times10^{-5}\%$) of disassociated fuel molecules into radicals reduces the ignition delay dramatically, to effect only negligible delay in ignition and combustion. Such ignition and combustion delay reduction leads to many advantages, particularly in the context of internal combustion piston engines and allows control over the combustion process, as by controlling the rate of injection of the fuel into the combustion chamber.

However, the very elevated temperature at which this phenomenon occurs leads to difficulties in practicing such a method in that the various components must be designed to handle fuel at approximately 1000° F. or higher. If the fuel is maintained at such elevated temperatures for significant periods of time coke is formed tending to clog the fuel passages.

Accordingly, it is an object of the present invention to provide an arrangement and method for achieving negligible ignition delay, i.e., hypergolic combustion, by the disassociation of a sufficient proportion of fuel molecules to enable hypergolic combustion as described in the aforementioned U.S. Pat. No. 4,448,176 and SAE papers, without the need for heating the fuel to very elevated temperatures.

SUMMARY OF THE PRESENT INVENTION

This and other objects of the present invention which will become apparent upon a reading of the following specification and claims are achieved by a method and arrangement for exciting the fuel molecules to establish a sufficient proportion of radicals to achieve substantially instantaneous ignition by an irradiation of each quantity of fuel introduced to the combustion chamber with a beam of ultraviolet (UV) radiation.

The UV beam may also irradiate a mixture of the fuel and oxygen such that the oxygen molecules may also be disassociated to further enhance the ignition combustion process.

UV irradiation may also be combined with fuel preheating which also acts to disassociate a proportion of the fuel molecules required for hypergolic combustion.

The arrangement and method for UV irradiation may be accomplished by passing each quantity of fuel through an irradiation chamber into which is directed a beam of UV radiation from a UV beam generator, which may take the form of a laser or mercury vapor lamp.

The UV irradiation can also take place in an auxiliary combustion chamber into which fuel-air mixture is introduced to irradiate both the fuel and air to dissassociate a proportion of both fuel and oxygen molecules prior to injection.

The UV irradiation can also take place directly in the combustion chamber as of a reciprocating piston internal combustion engine, by directing the UV beam at the fuel injection nozzle to activate the fuel as it is injected.

The UV irradiation can also be accomplished by means of a rotating mirror reflecting a UV beam from a UV beam generator to sweep the combustion chamber to directly control the progress of the combustion process.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations withing the scope of the appended claims.

The present invention is contemplated as having application to any number of combustion devices in which fuel is delivered to a location whereat combustion of the fuel takes place, i.e., a combustion chamber. The fuel is mixed with an oxidizer, typically atmospheric oxygen, at the combustion site in order that combustion of the fuel may there proceed.

The reduction of ignition and combustion delay is of particular importance in the context of internal combustion engines and the following embodiments will be described in conjunction with an internal combustion piston engine, but is should be understood that the method and arrangement according to the present invention may be applied to other such combustion devices.

Figure 1:
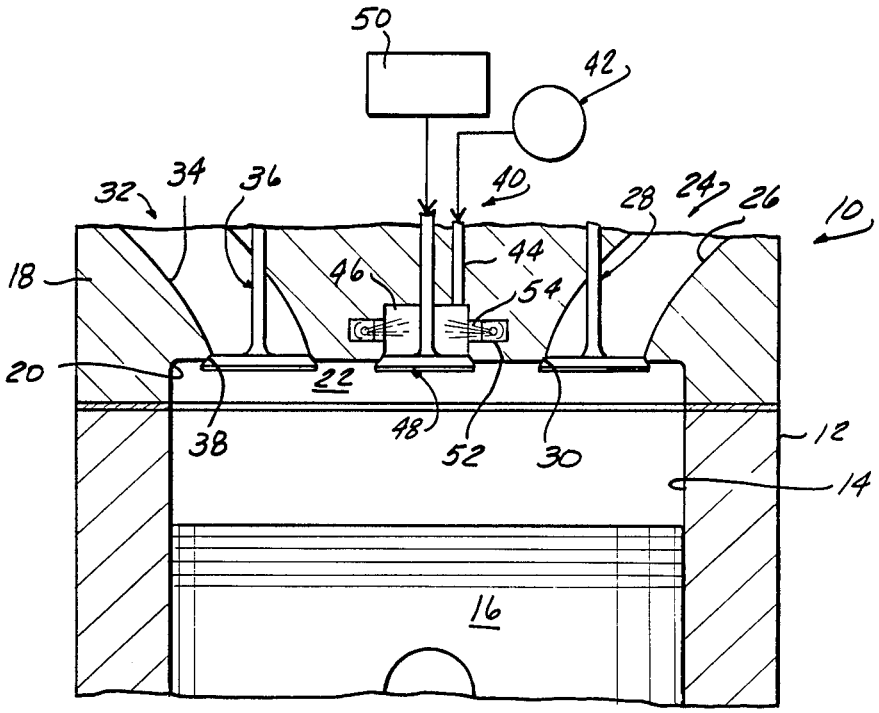
FIG. 1 is a sectional view of a cylinder of an internal combustion piston engine incorporating a fuel treatment arrangement according to the present invention.

Accordingly, referring to FIG. 1, there is illustrated an internal combustion piston engine 10, a single cylinder thereof, illustrated in order that the principle of the present invention may be understood. The engine 10 includes a cylinder block 12 having a cylinder bore 14 formed therein, in which is mounted a piston 16, driven by a crankshaft (not shown) to be reciprocated in the manner well known.

Affixed to the cylinder block 12 is a cylinder head 18 having interior surface portions 20, defining together with the piston 16 a combustion chamber 22, within which combustion of fuel takes place to cause driving of the piston 16 by the resultant gas pressure generated from the combustion process.

An air intake system 24 for introducing air into the combustion chamber 22 is provided including an air intake port 26 and air intake valve 28 movable to cover and uncover a valve seat 30 to control communication of the combustion chamber 22 with the air intake system. The intake valve 28 is operated by a suitable operating mechanism which may include a cam shaft (not shown) and valve lifters, etc., as well known.

Also provided is an exhaust system 32 through which the products of combustion may be expelled from the combustion chamber 22 after each combustion cycle, which system includes an exhaust passage 34 formed in the cylinder head 18 and an exhaust valve 36 also operated by means of a valve actuation means such as a cam shaft rotated by the engine, causing opening and closing movement of the valve 36 on a valve seat 38, in timed relation to the piston 16 movement and the injection of fuel.

There is also provided a fuel delivery system generally indicated at 40, which includes a source of fuel under pressure, for purposes of the present invention, preferably preheated to be raised to a moderately elevated temperature, i.e., approximately 500° F.

Such a system may include a pump receiving fuel from a fuel tank, means for passing said fuel through a heat exchanger located in the engine exhaust system, or some other suitable preheating arrangement such as an electrical resistance heater.

Such exhaust system heat exchangers are disclosed in the prior art, i.e., in U.S. Pat. No. 4,201,167; and also in co-pending application, Ser. No. 812,863, filed Dec. 26, 1985, now U.S. Pat. No. 4,669,433.

The fuel delivery system 40 includes a fuel passage 44 receiving such preheated fuel from the source 42, directing it so as to be atomized into an irradiation chamber 46. Communication of the irradiation chamber 46 with the combustion chamber 22 is controlled by a valve 48 operated by a suitable valve actuation mechanism indicated schematically at 50, which allows controlled injection of fuel from the irradiation chamber 46 into the combustion chamber 22.

It will be appreciated that the source of preheated fuel 42 must supply the fuel under sufficiently high pressures as to allow the fuel to be injected into the combustion chamber 22 at a time when relatively high pressures exist within the combustion chamber 22.

According to the concept of the present invention, each quantity of fuel received within the irradiation chamber 46 is irradiated with a beam of ultraviolet (UV) electromagnetic radiation of such intensity as to excite a sufficient proportion of the fuel molecules to enable hypergolic combustion, as recited above.

It has been discovered that electromagnetic radiation in the ultraviolet region of the spectrum has sufficient energy to cause such fuel molecules to be excited to an elevated state at which such disassociation occurs.

Accordingly, means are provided for generating a UV beam which is directed into the interior of the irradiation chamber 46. Such UV beam generator is depicted diagrammatically as a mercury vapor lamp 52 which may be isolated from the irradiation chamber 46 by a window 54 transparent to the UV radiation and of sufficient strength to withstand the relatively high pressures and temperatures in the chamber 46.

The mercury vapor lamp 52 comprises a suitable source of an electromagnetic beam of UV such as to enable UV beam irradiation of each quantity of fuel passing into the irradiation chamber 46.

The preheating of the fuel in the fuel delivery system 40 to moderately elevated temperatures raises a portion of the fuel molecules to an excited state at which disassociation occurs, such that only an additional incremental proportion of the molecules need by excited by irradiation in the irradiation chamber 46. The total proporation of molecules necessary to be excited is approximately $3\times10^{-5}\%$ of the total fuel molecules to achieve substantially instantaneous ignition according to the concept of U.S. Pat. No. 4,448,176, and the other references cited above.

The total energy required to partially disassociate all the molecules in a gram of hydrocarbon fuel has been theoretically approximated at 25,000 joules. However, as also developed theoretically in the above-cited references, only approximately $3\times10^{-5}\%$ of the fuel molecules needs to be disassociated to achieve hypergolic combustion, i.e., substantially instantaneous ignition and combustion. Further, a significant proportion of fuel molecules can be excited by other means such as by preheating of the fuel and/or the use of a contact of the preheated fuel with a catalyst, such that only the increased proportion of fuel molecules required to achieve hypergolic combustion is required to be excited by irradiation by the UV beam.

Figure 2:
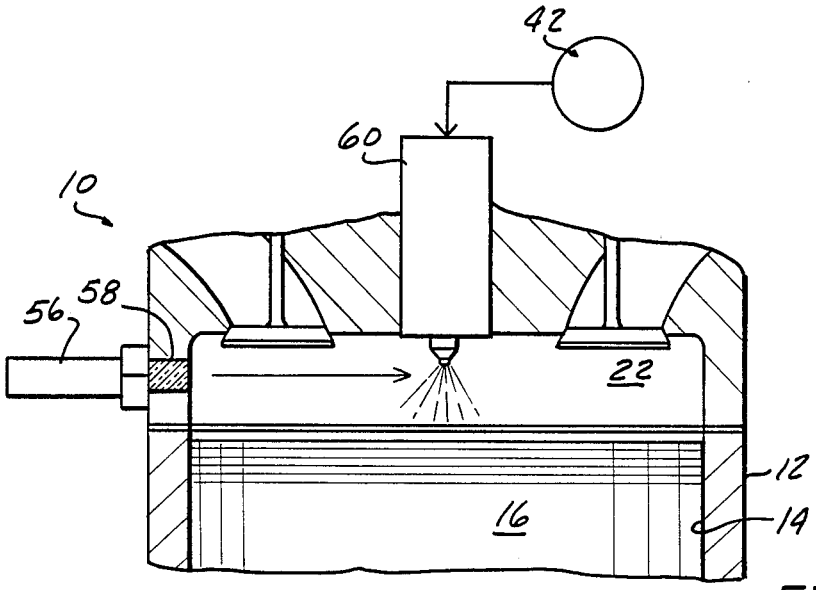
FIG. 2 is a fragmentary partially sectional view of an internal combustion piston engine incorporating an alternate embodiment of the arrangement according to the present invention.

FIG. 2 depicts an alternate embodiment in which a UV laser device 56 is employed as the UV beam generator, mounted to the side of the engine 10 such as to direct a UV beam through a UV transparent window 58 across the combustion chamber 22 such as to irradiate fuel as it is injected from a fuel injector 66 which receives fuel from the preheated fuel source 42.

This arrangement also provides irradiation of a portion of the oxygen molecules in the combustion chamber 22 to enhance further the ignition process by disassociation of the oxygen molecules.

Figure 3:
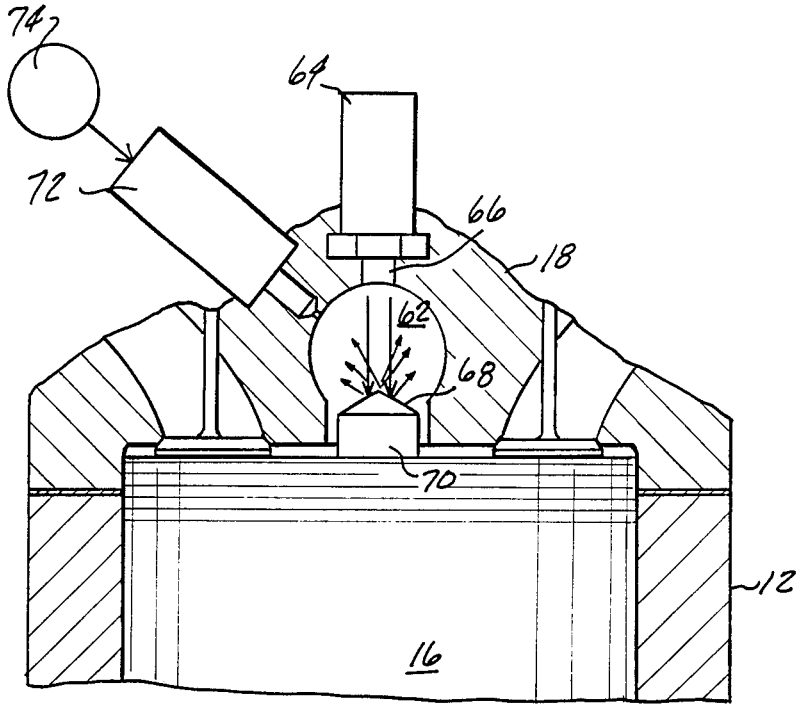
FIG. 3 is a fragmentary sectional view of an internal combustion piston engine incorporating another alternate embodiment of the arrangement according to the present invention.

Referring to FIG. 3, the irradiation of oxygen and fuel mixture may be accomplished by the use of an auxiliary combustion chamber 62 formed in the cylinder head 18. A UV laser 64 is mounted such as to direct a beam of UV radiation through a transparent window located at the top of the auxiliary combustion 62 against a conical mirror surface 68 carried by a central plug 70 mounted to the face of the piston 16 such as to move into the auxiliary combustion chamber 62 as the piston 16 approaches top dead center.

The conical reflector surface 68 is aligned such as to reflect the beam generated by the laser deivce 64 and disperse the same within the auxiliary combustion chamber 62. Fuel is adapted to be injected into the auxiliary combustion chamber 62 through an injector nozzle 72 receiving preferably preheated fuel from a fuel delivery system 74. Vaporized or liquid fuel in the auxiliary combustion chamber 62 is thus irradiated by the reflected beam as also are a proportion of the oxygen molecules present to produce disassociation of a substantial proportion of the fuel and oxygen molecules to an extent necessary to achieve the substantially instantaneous ignition.

Figure 4:
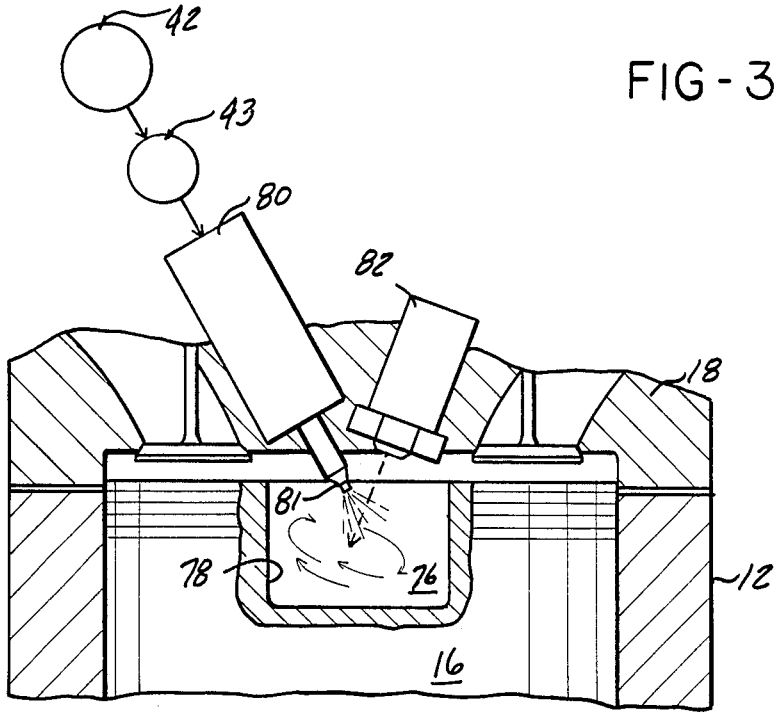
FIG. 4 is a fragmentary partially sectional view of a cylinder of an internal combustion piston engine using yet another arrangement according to the present invention.

Referring to FIG. 4, an auxiliary combustion chamber 76 is formed by a recess 78 in the face of the piston 16 with a fuel injection nozzle mounted in the cylinder head 18 such as to inject a swirling flow of fuel into the auxiliary combustion chamber 76. The injector nozzle 80 receives fuel from other components of the fuel delivery system 42, such fuel being preheated in a heater represented diagrammatically at 43.

A laser device 82 is also mounted in the cylinder head 18 and adapted to generate a beam of UV radiation directing the same at a region adjacent the tip 81 of the injection nozzle 80 such as to irradiate the injected fuel and also the oxygen molecules present within the auxiliary combustion chamber 76.

Figure 5:
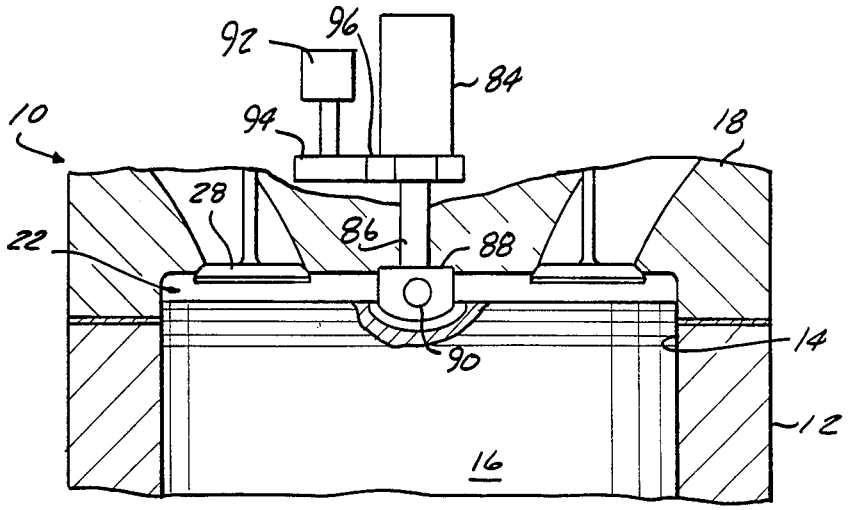
FIG. 5 is a partially sectional fragmentary view of a cylinder of an internal combustion piston engine incorporating still another arrangement according to the present invention.

Referring to FIG. 5, yet another arrangement is depicted, in which a beam of UV radiation is swept through a combustion chamber 22 of the piston engine 10 such as to control the combustion process by irradiation of each segment of fuel-air mixture disposed in the combustion chamber 22.

In this arrangement, a fuel-air mixture is introduced into the combustion chamber 22 as by a conventional system (not shown), or by a fuel injector (also not shown). A UV laser device 84 is mounted in the cylinder head 18 and directs a beam of UV radiation through a tube 86 mounted for rotation with a mirror assembly cover 88 reflecting the beam such as to be emitted from a window 90 formed in the mirror assembly 88.

A rotary drive means is provided for the housing 86 and mirror cover assembly 88 such as depicted by the rotary drive motor 92 and gearing 94 and 96, such as to rotate the mirror cover assembly 88 and cause the reflected UV beam to be swept through the combustion chamber 22. Preferably one revolution per ten crank angle degrees of motion of piston 16 is provided to complete ignition within the ten degree crank angle. Accordingly, ignition and combustion will progress through the combustion chamber 22 at a rate controlled by rotation of the mirror cover assembly 88.

Accordingly, it can be appreciated that the use of a UV beam generator and irradiation of fuel molecules will produce the end result of substantially instantaneous ignition and controlled combustion which allows the advantages therefrom, without the requirement of heating the fuel to the relatively elevated temperatures required to achieve this result by heating alone. By combining the preheating of the fuel and UV irradiation, each may be implemented to moderate degrees.

The method and arrangement as described above is of course capable of many forms and variations as illustrated by the various embodiments disclosed, and as also noted above, is able to be employed in other combustion devices in order to achieve a hypergolic combustion process.

We claim:

1. Apparatus for producing hypergolic combustion of a fuel-oxidant mixture in a combustion chamber of a combustion device of the type including a fuel delivery system for directing fuel into said combustion chamber, the improvement comprising an arrangement for controlling the progress of combustion of said fuel oxidant mixture in said combustion chamber by irradiation of said fuel to cause dissassociation of a sufficient proportion of fuel molecules to enable hypergolic combustion, said arrangement including UV beam generator means for producing a beam of electromagentic radiation in the ultraviolet range of the spectrum, and an irradiation arrangement for passing said UV beam through each quantity of fuel successively so as to irradiate the entire quantity of fuel passing through said fuel delivery system prior to being combusted within said combustion chamber, said UV beam of sufficient intensity to disassociate a sufficient proportion of fuel molecules in each said quantity of fuel irradiated by said beam to enable subsequent hypergolic combustion of said fuel in said combustion chamber; said irradiation arrangement further including a fuel irradiation chamber separate from said combustion chamber and said fuel delivery system including means of injecting each quantity of said fuel into said irradiation chamber prior to being delivered to said combustion chamber; and further including a window in said irradiation chamber substantially transparent to said UV beam and disposed so that said UV beam passes therethrough and into said irradiation chamber to completely irradiate fuel injected therein.

2. Apparatus for producing hypergolic combustion of a fuel-oxidant mixture in a combustion chamber of a combustion device of the type including a fuel delivery system for directing fuel into said combustion chamber, and a piston reciprocally mounted in a cylinder to define said combustion chamber comprised of a space above an end face of said piston and below a surface opposite said piston end face, the improvement comprising an arrangement for controlling the progress of combustion of said fuel-oxidant mixture in said combustion chamber by irradiation of said fuel to cause dissassociation of a sufficient proportion of fuel molecules to enable hypergolic combustion, said arrangement including UV beam generator means comprising a laser device producing a UV beam of electromagnetic radiation in the ultraviolet range of the spectrum, and an irradiation arrangement for passing said beam through each quantity of fuel successively so as to irradiate the entire quantity of fuel combusted within said combustion chamber prior to the combustion of each said quantity of fuel therein as it passes through said fuel delivery system, said UV beam of sufficient intensity to disassociate a sufficient proportion of fuel molecules in each said quantity of fuel irradiated by said beam to enable subsequent hypergolic combustion of said fuel in said combustion chamber; a recess formed into said end face of said piston; fuel injector means injecting each quantity of fuel successively into said recess as said piston moves to be adjacent said opposite surface; said laser device directing said UV beam into said recess so as to irradiate said injected fuel therein.

3. Apparatus for producing hypergolic combustion of a fuel-oxidant mixture in a combustion chamber of a combustion device of the type including a fuel delivery system for directing fuel into said combustion chamber wherein said fuel is intermixed with an oxidant, the improvement comprising an arrangement for controlling the progress of combustion of said fuel-oxidant mixture in said combustion chamber by irradiation to cause dissassociation of a sufficient proportion of fuel molecules to enable hypergolic combustion, said arrangement including beam generator means comprising a laser device producing a beam of electromagnetic radiation, and an irradiation arrangement for passing said beam through each quantity of fuel-oxidant mixture successively so as to irradiate the entire quantity of fuel combusted within said combustion chamber to control the combustion of each said quantity of fuel therein as it passes through said fuel delivery system, said beam of sufficient intensity to disassociate a sufficient proportion of fuel molecules in each said quantity of fuel irradiated by said beam to enable subsequent hypergolic combustion of said fuel in said combustion chamber; said irradiation arrangement including a mirror rotatably mounted in said combustion chamber, said beam directed to reflected by said mirror to pass through a localized region of said combustion chamber;

means for rotating said mirror to cause said UV beam to successively be passed through each region of said combustion chamber, whereby the combustion of said fuel-oxidant mixture progresses at the rate defined by rotation of said mirror.

* * * * *